United States Patent [19]

Ito et al.

[11] Patent Number: 4,975,149

[45] **Date of Patent: * Dec. 4, 1990**

[54] PROCESS FOR PRODUCING FIBER AGGREGATE

[75] Inventors: Tomohito Ito, Ohbu; Fukuo Gomi, Nagoya; Renichi Isomura, Kariya, all of Japan

[73] Assignee: Kabushiki Kaisha Toyoda Jidoshokki Seisakusho, Kariya, Japan

[ * ] Notice: The portion of the term of this patent subsequent to Nov. 22, 2005 has been disclaimed.

[21] Appl. No.: 273,981

[22] Filed: Nov. 21, 1988

Related U.S. Application Data

[63] Continuation-in-part of Ser. No. 945,532, Dec. 19, 1986, Pat. No. 4,786,366.

[30] Foreign Application Priority Data

| | | | |
|---|---|---|---|
| Dec. 28, 1985 | [JP] | Japan | 60-299558 |
| Jan. 10, 1986 | [JP] | Japan | 61-004015 |
| Jan. 17, 1986 | [JP] | Japan | 61-008441 |

[51] Int. Cl.[5] ..... D21H 13/00

[52] U.S. Cl. ..... 162/102; 162/145; 162/146; 162/157.1; 162/192

[58] Field of Search ..... 162/102, 145, 152, 192, 162/157.1, 146; 264/108, 24

[56] References Cited

U.S. PATENT DOCUMENTS

| | | | |
|---|---|---|---|
| 3,127,668 | 4/1964 | Troy | 162/157.1 |
| 3,497,419 | 2/1970 | Winer | 162/192 |

FOREIGN PATENT DOCUMENTS

| | | | |
|---|---|---|---|
| 1914316 | 10/1970 | Fed. Rep. of Germany | 264/24 |
| 1257349 | 12/1971 | United Kingdom . | |
| 1259626 | 1/1972 | United Kingdom . | |

*Primary Examiner*—Peter Chin

*Attorney, Agent, or Firm*—Berman, Aisenberg & Platt

[57] ABSTRACT

The present invention relates to a process for producing fiber aggregate which comprises a dispersion step of dispersing fibers in the form of short fiber, whisker, or a mixture thereof into a dielectric fluid; an orientation step of placing the dielectric fluid containing said fibers dispersed therein in a space between a positive electrode and a negative electrode across which a high voltage is applied, whereby causing individual fibers in the dielectric fluid to electrostatically orient, with one end pointing to the positive electrode and the other end pointing to the negative electrode; and an aggregating step of aggregating the statically oriented fibers while keeping the oriented step, whereby producing fiber aggregate in which said fibers are mostly one-dimensionally oriented. Small amounts of surface active agent in the dielectric liquid promote fiber orientation in addition to dispersing the fibers.

4 Claims, 4 Drawing Sheets

PROCESS FOR PRODUCING FIBER AGGREGATE

RELATED APPLICATION

This application is a continuation-in-part of Ser. No. 945,532, filed Dec. 19, 1986, now U.S. Pat. No. 4,786,366.

BACKGROUND OF THE INVENTION

The present invention relates to a process for producing fiber aggregate, and more particularly, it relates to a process for producing fiber aggregate in which most fibers are about one-dimensionally oriented. "One-dimensionally oriented" means that many fibers are oriented in substantially the same direction. This definition is applied not only to the fiber aggregate but also to the orientation step mentioned later. Surface active agents promote fiber orientation in the dielectric liquid.

Heretofore, fiber aggregate of short fibers or whiskers has been produced in the following means.

A centrifugal forming method which employs a centrifugal forming apparatus as shown in FIG. 8 (Japanese Patent Laid-open No. 65200/1985). According to this method, an aqueous suspension of silicon carbide whiskers or the like is fed through the supply pipe 24 to the porous cylindrical vessel 23 which is lined with the filtration film 25 and disposed in the outer cylinder 21. The hollow fiber aggregate 26 is formed by centrifugal action. Water is discharged from the outlet 22.

Another conventional method which employs a suction forming apparatus as shown in FIG. 9. According to this method, a prescribed amount of fiber-containing fluid 34 is fed to the cylinder 31, and a pressure is applied to the fluid 34 by the plunger 32 arranged above the cylinder 31. At the same time, the filtrate is removed by vacuum suction through the filter 33 disposed at the bottom of the cylinder 31. Thus the fibers in the fluid are oriented and aggregate.

Other conventional methods include the papermaking method and spraying method.

The fiber aggregate formed by the centrifugal method or suction method is not composed of one-dimensionally oriented fibers, but is composed mainly of two or three-dimensionally oriented fibers. The fiber aggregate with such orientation has a disadvantage that it does not provide a sufficient strength in the desired one-dimensional direction when incorporated into fiber-reinforced metal (referred to as FRM hereinafter). Additional disadvantages are the low volume ratio of fiber and the excessive spring back at the time of compression molding.

According to the conventional method, it was impossible to produce one-dimensionally oriented fiber aggregate and it was only possible to produce two or three dimensionally oriented fiber aggregate.

SUMMARY OF THE INVENTION

The process of the invention uses surface active agents to promote fiber orientation in the dielectric liquid in addition to dispersing the fibers and produces fiber aggregate in which most fibers are one-dimensionally oriented. The fiber aggregate produced according to the process of the present invention has a high fiber volume ratio and a low degree of spring back. When incorporated into FRM (Fiber Reinforced Metal), it provides FRM having a high strength in the desired one dimension.

DETAILED DESCRIPTION OF THE DRAWINGS

These and other objects, as well as features of this invention will become apparent by reading the following description referring to the accompanying drawings, wherein.

DETAILED DESCRIPTION OF THE INVENTION

Figure 1:
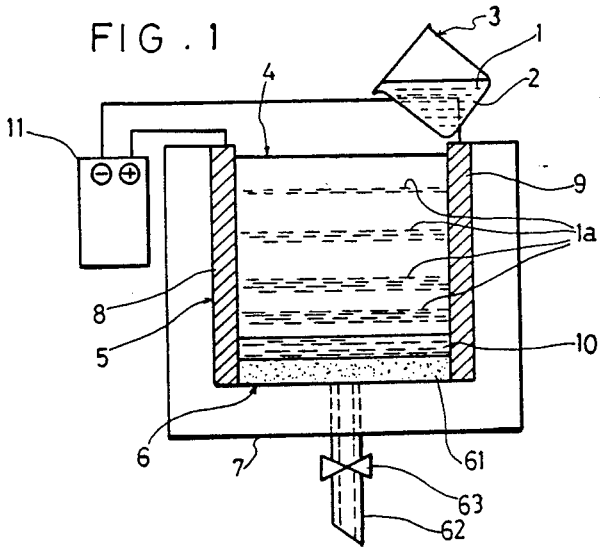
FIG. 1 is a schematic sectional view illustrating the process for producing fiber aggregate, said process including the step of filtering the dielectric fluid through a porous filter.

The first step of the process of the present invention for producing fiber aggregate is the dispersion step in which short fibers, whiskers, or a mixture thereof are dispersed into a dielectric liquid including a dielectric fluid and a surface active agent.

The fibers used in the dispersion step are short fibers, whiskers or a mixture thereof. Short fibers and whiskers of any kind can be used. They are not specifically limited in diameter and length. Also, they are not limited in material so long as they are capable of electrostatic orientation in the dielectric fluid when a high voltage is applied across the positive and negative electrodes. The material of the fiber includes, for example, alumina, silica, alumina-silica, beryllia, carbon, silicon carbide, glass, and metals. Either fibers of single material or a mixture of fibers of different materials may be used.

The dielectric fluid means a fluid which exhibits the dielectric properties upon application of a high voltage. Examples of the dielectric fluid include carbon tetrachloride, fluorine- and chlorine-substituted hydrocarbon, n-hexane, and cyclohexane. Preferable among them is carbon tetrachloride. Fluorine- and chlorine-substituted hydrocarbons are preferable from the standpoint of handling safety.

Fibers of some kind or state may need surface treatment to loosen fibers sticking together. To facilitate the dispersion of fibers, a proper amount of surface active agent, especially a nonionic surface active agent should be added to the dielectric fluid.

The amount of the surface active agent absorbed around the fibers (which promotes fiber orientation) is estimated by detecting the resistivity of the dielectric liquid. Thus, fiber orientation is determined by the resistivity of the liquid medium. The liquid medium consists essentially of a dielectric fluid and a surface active agent and has a resistivity of from $4\times10^{10}$ to $1\times10^{13}$ ohm·cm.

Other short fibers also show similar results to the alumina short fibers. Any surface active agent can be employed as far a it dissolves in the dielectric liquid and disperses fibers or whiskers. Experiments have been conducted by using several nonionic active agents, but all the nonionic active agents show similar results.

Fiber dispersion, fiber orientation and liquid resistance are maintained at certain values irrespective of fiber concentration, as far as the ratio of the surface active agent to the fibers or whiskers are kept constant. active agent to the fibers or whiskers are kept constant.

The second step of the process of the present invention is the orientation step, in which the dielectric fluid containing the fibers dispersed therein is placed in a space between a positive electrode and a negative electrode across which a high voltage is applied, so that individual fibers in the dielectric fluid are electrostatically oriented, with one end pointing to the positive electrode and the other end pointing to the negative electrode. The state in which most fibers are oriented in one direction across the positive and negative electrodes is referred to as "one-dimensional orientation".

In the orientation step, usually an electric field of about 0.1 to 5 kV/cm is generated between the positive and negative electrodes. An electric field weaker than 0.1 kV/cm is not enough for the electrostatic orientation of fibers; and an electric field stronger than 5 kV/cm disturbs the dielectric fluid and interferes with the orientation of fibers. Preferred electric field is about 1 to 2 kV/cm. It is suitable for static orientation of fibers with a minimum disturbance of the dielectric fluid. The intensity of electric field should be properly established according to the dielectric properties of the fibers and dielectric fluid to be used and the thickness of the fiber aggregate to be produced.

The individual fibers which have been electrostatically oriented as mentioned above are mostly strung to one another in one direction (referred to as electrode direction hereinafter) perpendicular to the direction in which the fibers settle. The stringing fibers settle faster than discrete fibers.

The third step of the process of the present invention is the aggregating step in which the eletrostatically oriented fibers are aggregated while keeping the oriented state, whereby producing fiber agrgregate in which the fibers are mostly one-dimensionally oriented.

The aggregating step is performed by gravitationally settling the fibers which have been oriented in the orientation step, for example in the state of closing a drain cock 63 on a drain pipe 62, as shown in FIG. 1. Further, the aggregating step is performed by filtering the dielectric fluid containing the fibers which have been oriented in the orientation step, in the direction perpendicular to the direction of the orientation of the fibers so that the oriented fibers 1*a* are collected on the filter 61, for example in the state of opening the drain cock 63 on the drain pipe 62, as shown in FIG. 1. According to this method of filtering the dielectric fluid, the aggregation of fiber can be carried out in a short time. The filtering can be performed in the state of vacuum suction. The dielectric fluid may be removed through the filter disposed at the whole filtration surface in which the oriented fibers are aggregated. Therefore, convection of the dielectric fluid discharged is prevented and hence the orientation of the fibers is not disturbed and fiber aggregate of good orientation is obtained. The filter can be composed of a porous ceramic.

The above-mentioned dispersion step, orientation step, and aggregating step can be performed continuously.

According to the process of the present invention, a fiber aggregate its thickness being relative thick in the form of mat and a fiber aggregate its thickness being relative thin in the form of film can be obtained.

The one-dimensionally oriented fiber removed from the apparatus is cut to desired shape or placed on top of another to form a fiber aggregate for FRM.

The apparatus used for the process of the present invention is schematically shown in FIG. 1. It is made up to the orientation vessel 7, the paired positive electrode 8 and negative electrode 9, and the high-voltage source 11. The orientation vessel 7 is made up of a receptacle 4 to receive the dielectric fluid 2 into which short fibers 1 are dispersed; the outlet 6 to discharge the dielectric fluid 2; and the orientation space 5 in which the dielectric fluid moves downward across the receptacle 4 and the outlet 6. The positive electrode 8 and negative electrode 9 are vertically disposed a certain distance apart horizontally in the orientation space 5 of the orientation vessel 7. The high-voltage source 11 applies a high voltage across the positive electrode 8 and negative electrode 9. The supply unit 3 to feed the fiber-dispersed dielectric fluid may be installed above the receptacle 4.

Figure 11:
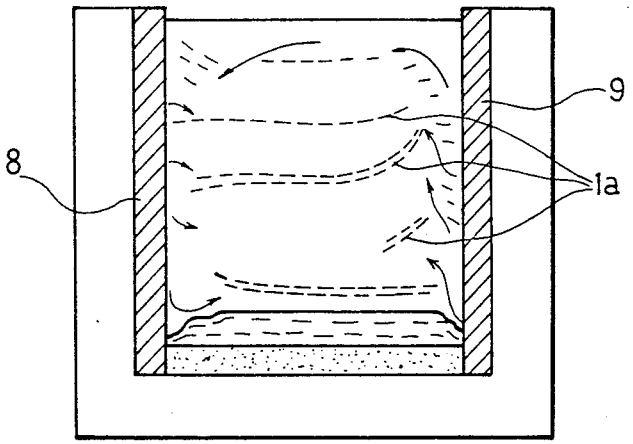
FIG. 11 is a sectional view illustrating the turbulence of the dielectric fluid that takes place when the convection preventing membrane is not disposed at both sides of the positive and negative electrodes.

According to the process of the present invention, the dispersion step, the orientation step, and the aggregating step are performed consecutively, the static orientation of the fibers may be stabilized more by disposing a convection preventing membrane inside at least either of the positive electrode or negative electrode. In the process without this convection preventing membrane, convection takes place in the dielectric fluid when a high voltage, for example 5 to 10 kV or higher, is applied across the positive and negative electrodes, as shown in FIG. 11. (The convection is presumably due to the charge injection into the dielectric fluid.) Convection disturbs the oriented fibers, the stringing fibers 1*a*, and also the aggregated fibers to disturb the one-dimensionally oriented state. The convection preventing membrane eliminates these disadvantages, improves the one-dimensional orientation and makes possible the one-dimensional orientation of shorter fibers.

The convection preventing membrane is intended to prevent the dielectric fluid from generating convection in the orientation step and the aggregating step. It is disposed inside at least either of the positive electrode or the negative electrode, preferably both.

The convection preventing membrane may be ion-exchange membrane or paper, the former being preferable. The ion-exchange membrane is not necessarily a resin membrane; but it is usually a cation exchange resin membrane or anion exchange membrane. The ion-exchange resin membrane is effective in preventing convection.

The convection preventing membrane to be disposed inside the positive electrode should preferably be an anion exchange membrane, and the one to be disposed inside the negative electrode should preferably be a cation exchange membrane. The anion exchange membrane prevents cations, which are generated on the positive electrode, from flowing toward the oriented fibers. The cation exchange membrane prevents anions, which are generated on the negative electrode, from flowing toward the oriented fibers. These actions prevent the convection of the dielectric fluid containing the oriented fibers and stabilize the static orientation of the fibers.

The convection preventing membrane can also be paper such as filter paper.

The process of this invention comprising the dispersion step, orientation step, and aggregating step may include an additional step of removing ionic substances from the separated dielectric fluid so that the dielectric fluid is recycled to the dispersion step.

In the process in which the dispersion step, orientation step, and aggregating step are performed consecutively, ions are generated when a high voltage, for example 5 to 10 kV or higher, is applied across the positive electrode and the negative electrode. The generation of ions results from the charge injection into the dielectric fluid, impurities contained in the dielectric fluid, and surface active agent. In addition, the dielectric fluid originally contains ionic substances. Therefore, if the dielectric fluid separated in the aggregating step is used repeatedly, the concentration of ionic substances in the dielectric fluid increases and the ionic substances induce the convection of the dielectric fluid. The convection disturbs the oriented fibers, stringing fibers, aggregated fibers, and one-dimensional orientation.

The additional step is intended to overcome the above-mentioned disadvantage. It makes it possible to use the separated dielectric fluid repeatedly without causing the undesirable convection of the dielectric fluid. Therefore, the process including the additional step produces fiber aggregate of good one-dimensional orientation, making possible the one-dimensional orientation of smaller fibers.

The above-mentioned ionic substances denote anions, cations and the like which are generated by the charge injected into the dielectric fluid and the impurities or surface active agent contained in the dielectric fluid. The charge injection takes place when a high voltage is applied to the dielectric fluid through the positive and negative electrodes. In addition, the above-mentioned ionic substances include also any other ionic substances originally contained in the dielectric fluid and fibers.

Figure 12:
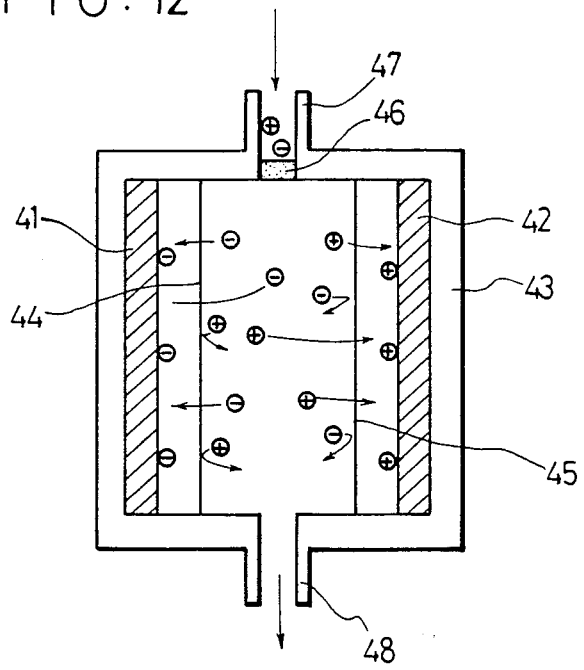
FIG. 12 is a sectional view illustrating the apparatus for removing ionic substances which is used in Example 6.

The step of removing ionic substances can be accomplished by passing the dielectric fluid through the cation exchange membrane 45 (which removes cationic substances) and through the anion exchange membrane 44 (which removes anionic substances), while applying a static voltage to the dielectric fluid, as shown in FIG. 12. The dielectric fluid is one which is separated and discharged when fiber aggregate is produced.

The ion-exchange membrane used for this purpose is usually an ion-exchange resin membrane. In this case, an anion exchange resin membrane 44 is disposed inside the positive electrode 41 and a cation exchange resin membrane 45 is disposed inside the negative electrode 42.

The step of removing ionic substances may also be accomplished by removing ionic substances from the dielectric fluid by adsorption with at least one kind of a cation exchange resin and anion exchange resin, and other adsorbents.

The removing of ionic substance may be accomplished by using an apparatus as shown in FIG. 12. It is enclosed in the holder 43 provided with the inlet 47 and outlet 48. The inlet 47 communicates with the outlet of the orientation vessel mentioned above. The inlet 47 is provided with the filter 46. The holder 43 has the paired positive electrode 41 and the negative electrode 42 arranged vertically a certain distance apart horizontally. The anion exchange membrane 44 is disposed inside the positive electrode 41 and the cation exchange membrane 45 is disposed inside the negative electrode 42.

According to the process of the present invention, fiber aggregate is produced by the process comprising the orientation step of placing a dielectric fluid containing fibers dispersed therein in a space between a positive electrode and a negative electrode across which a high voltage is applied, whereby causing individual fibers in the dielectric fluid to electrostatically orient, with one end pointing to the positive electrode and the other end pointing to the negative electrode; and the aggregating step of aggregating the electrostatically oriented fibers while keeping the oriented state. The fiber aggregate produced by this process is one in which said fibers are mostly one-dimensionally oriented. The fiber aggregate provides FRM having an extremely high strength in the direction of one-dimensional orientation.

The fiber aggregate produced from short fibers or whiskers according to the process of the present invention provides FRM having the same properties as those of FRM reinforced with long fibers. Short fibers are less expensive than long fibers, and whiskers provide a higher strength than long fibers.

The process of the present invention for producing fiber aggregate by the above-mentioned orientation step and aggregating step may be modified to stabilize more the one-dimensional orientation of fibers. This modification includes the convection preventing membrane which is disposed inside at least either of the positive electrode or negative electrode. The convection preventing membrane prevents cations or anions from flowing toward the oriented fibers. (The cations and anions are generated by the charge injection into the dielectric fluid that takes place when a high voltage is applied across the electrodes.) As the results, the convection of the dielectric fluid in the orientation vessel is prevented, and the fibers are oriented more stably. The process with this modification provides fiber aggregate in which most fibers are one-dimensionally oriented. Thus the fiber aggregate provides FRM having an extremely high strength in the direction of the one-dimensional orientation. In addition, the process with this modification permits the orientation of fibers of smaller size because it prevents the convection of the fluid. It also permits the production of thick fiber aggregate by the application of a higher voltage which increases the force of fiber orientation, because the convection prevention is effective even when a high voltage is applied.

The process of the present invention for producing fiber aggregate is further modified by adding, after the above-mentioned aggregating step, the step of removing ionic substances from the separated dielectric fluid. This modification further stabilizes the one-dimensional orientation of fibers, because the convection of the dielectric fluid induced by the presence of ionic substances is minimized. This additional step removes ions and ionic substances from the dielectric fluid. (The ions are generated by the charge injection into the dielectric fluid, impurities in the dielectric fluid, and surface active agent. The charge injection takes place when a high voltage is applied to the positive and negative electrodes. In addition, the ionic substances are also originally present in the dielectric fluid.) The process with this modification provides fiber aggregate in which most fibers are more one-dimensionally oriented. Thus the fiber aggregate provides FRM having an extremely high strength in the direction of the more one-dimensional orientation. In addition, the process with this modification permits the orientation of fibers of smaller size because it prevents the convection of the fluid. It also permits the production of thick fiber aggregate by the application of a higher voltage which increase the force of fiber orientation, because the convection prevention is effective even when a high voltage is applied.

According to the process of the present invention, it is possible to produce fiber aggregate in which most fibers are one-dimensionally oriented with a minimum of fiber entanglement. Therefore, the thus obtained fiber aggregate has a high fiber-volume ratio. Such fiber aggregate provides FRM having a high strength.

Furthermore, the fiber aggregate produced according to the process of the present invention has a low degree of spring back because it contains only few entaglements of fibers. Such fiber aggregate provides FRM having a high precision.

DETAILED DESCRIPTION OF THE PREFERRED EMBODIMENT

The invention is now described with reference to the following examples.

(Example 1)

This example is designed to investigate the state of the one-dimensional orientation of fibers in the orientation step.

Alumina short fibers (having an average diameter of 3 μm and a length of 10 to 500 μm) without surface treatment were dispersed by stirring together with a small amount of nonionic surface active agent into carbon tetrachloride as the dielectric fluid.

The electrostatic orientation apparatus as shown in FIG. 1 was made ready. The apparatus is made up of the orientation vessel 7, the paired positive electrode 8 and negative electrode 9, and the high-voltage source 11. The orientation vessel 7 is made up of the receptacle 4 to receive the dielectric fluid 2 including surface active agent into which short fibers 1 are dispersed; the outlet 6 to discharge the dielectric fluid 2; and the orientation space 5 in which the dielectric fluid moves downward across the receptacle 4 and the outlet 6. The positive electrode 8 and negative electrode 9 are vertically disposed a certain distance apart horizontally in the orientation space 5 of the orientation vessel 7. The high-voltage source 11 applied a high voltage across the positive electrode 8 and negative electrode 9 to generate an electric field. The distance between the electrodes was 6 mm.

Carbon tetrachloride was placed in the space between the electrodes in the electrostatic orientation apparatus. A DC voltage of about 1 kV was applied across the electrodes. The dielectric fluid 2, including a small amount of nonionic surface active agent, into which the fibers 1 were dispersed was poured slowly into the receptacle 4 of the apparatus from the beaker 3.

Figure 3:
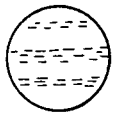
FIG. 3 is an enlarged schematic representation of the strung fibers shown in FIG. 2.
Figure 2:
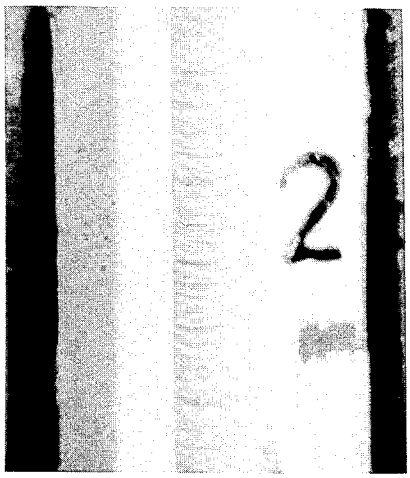
FIG. 2 is a photograph showing the state of one-dimensional orientation of fibers in Example 1. Fibers disposed in the dielectric fluid ar oriented and becomes strung between the positive and negative electrodes.

The fibers 1 underwent induction polarization in the dielectric fluid 2 and electrostatic orientation, with one end of the fiber pointing to the positive electrode 8 and the other end pointing to the negative electrode 9. The electrostatically oriented fibers 1 became strung while they were settling, and the strung fibers settled in the state of one-dimensional orientation in the direction across the positive and negative electrodes. This state is shown in FIGS. 2 and 3.

The amount of the surface active agent absorbed around the fibers, (which promotes fiber orientation) is estimated by detecting the resistivity of the dielectric liquid. Thus, fiber orientation is determined by the resistivity of the liquid medium. The dielectric liquid consists essentially of a dielectric fluid and a surface active agent and has a resistivity of from $4\times10^{10}$ to $1\times10^{13}$ ohm·cm Criticality of the above-specified liquid resistivity is apparent from the Table below.

TABLE

| surfactant/ fiber ratio (wt %) | dispersion | orientation | dielectric liquid resistivity (ohm · cm) |
|---|---|---|---|
| 0 (no surfactant) | Δ | Δ | $10^{14}$ or more |
| 0.00001 | Δ | Δ | $10^{13}$ |
| 0.0002 | | | $10^{13}$ |
| 0.0004 | | | $6\times10^{12}$ |
| 0.001 | | | $4\times10^{12}$ |
| 0.002 | | | $2\times10^{12}$ |
| 0.01 | | | $6\times10^{11}$ |
| 0.02 | | | $4\times10^{11}$ |
| 0.2 | | Δ | $4\times10^{10}$ |
| 0.3 | | Δ | $2\times10^{10}$ |

= satisfactory
Δ = unsatisfactory

The Table shows the results of the experiment about the relationship between the amount of the surface active agent, and fiber dispersion and orientation.

The surface active agent was added to the liquid in the amounts shown in the Table. The surface active agent used was Purai Saafu A212C produced by DAIICHI KOGYO PHARMACEUTICAL CO., LTD. It is a nonionic surface active agent which shows anion characteristic due to the O—H group contained. The dielectric liquid used was FREON 113 (tradename of DuPont, $CCl_2F{\cdot}CClF_2$). Alumina short fibers having an average diameter of 3 μm and a length of 10 to 500 μm were introduced at 5 g per liter of FREON-113.

As apparent from the Table, orientation of short fibers is varied with the amount of the surface active agent. The minimum amount of the surface active agent required for fiber orientation is larger than that required for fiber dispersion.

Other short fibers also show similar results to alumina short fibers. Any surface active agent can be employed as far as it dissolves in the dielectric liquid and disperses fibers or whiskers. Experiments have been conducted using several nonionic active agents, but all the nonionic active agents show similar results.

Fiber dispersion, fiber orientation and liquid resistance are maintained at certain values irrespective of fiber concentration, as far as the ratio of the surface active agent to the fibers or whiskers are kept constant.

With the strung fibers 1*a* kept in oriented state, the drain cock 63 on the drain pipe 62 was opened to discharge the dielectric fluid through the filter 61. In this way, the fibers were aggregated on the fiber 61 in the one-dimensionally oriented state.

The above-mentioned dispersion step, orientation step, and aggregating step were carried out consecutively until the fiber aggregate reached a desired thickness. The dielectric fluid remaining in the apparatus was removed through the drain pipe 62. Thus there was obtained the fiber aggregate 10 in the form of mat.

In this example, the strung fibers which had become one-dimensionally oriented in the direction across the positive and negative electrodes settled to form aggregate. During settling and aggregation, the dielectric fluid was discharged without turbulence owing to the filter 61 disposed at the bottom of the orientation space 5. Thus the resulting fiber aggregate 10 was one in which most fibers are one-dimensionally oriented. The fiber aggregate in this example is better in the state of electrostatic orientation than that obtained in Example 2. Therefore, it is considered that the state of one-dimensional orientation in the fiber aggregate is better than that (shown in FIG. 4) in the case of Example 2.

(Example 2)

One-dimensionally oriented fiber aggregate in the form of mat was produced in the same manner as in Example 1, except that (1) the distance between the positive electrode and the negative electrode was changed to 40 mm, (2) the fibers were washed with an alkali and acid for surface treatment, (3) the dielectric fluid was "FREON" ($C_2C1_3F_3$, trademark, made by Dupont Co., LTD.), and (4) the voltage applied was 5.5 kV.

The fiber aggregate obtained in this example exhibited almost the same one-dimensional orientation (not shown) as in Example 1 (FIGS. 2 and 3).

Figure 4:
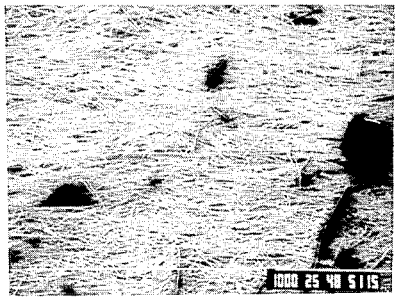
FIG. 4 is an enlarged photograph showing the surface of the fiber aggregate produced in Example 2.

The fiber aggregate obtained in this example was examined for one-dimensional orientation by observing the surface of the mat. As shown in FIG. 4 (40 magnifications), the fiber aggregate was found to have good one-dimensional orientation.

The fiber aggregate in this example was found to have a higher fiber volume ratio than the conventional one because most fibers are one-dimensionally oriented. The fiber aggregate was also found to have a low degree of spring back. Because of these characteristics, it provides FRM of high precision.

According to the process in this example, the dielectric fluid is removed through a corrosion-resistant porous filter attached to the bottom of the apparatus in which the oriented fibers are aggregated. Therefore, no turbulence occurs when the dielectric fluid is discharged and hence the orientation of the fibers is not disturbed and fiber aggregate of good orientation is obtained.

In addition, according to the process in this example, the dielectric fluid is charged continuously through the drain pipe so that the aggregation of fiber can be carried out in a short time.

(Example 3)

One-dimensionally oriented fiber aggregate in the form of large mat for the production of FRM was produced in the same manner as in Example 1, except that (1) the distance between the positive electrode and the negative electrode was changed to 100 mm, (2) an anion exchange membrane was disposed inside the positive electrode, a cation exchange membrane was disposed inside the negative electrode, and (3) a voltage of 10 to 15 kV was applied.

The fiber aggregate in this example was found to have almost the same one-dimensional orientation (not shown) as shown in FIG. 2 and 3. The fiber aggregate in this example was about 80 mm long and 10 to 20 mm thick.

Figure 5:
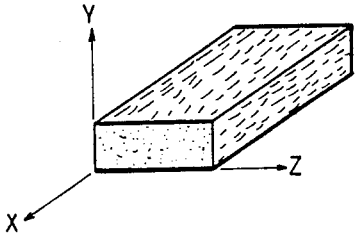
FIG. 5 is a schematic representation showing the X, Y, and Z axes of FRM made from the fiber aggregate produced in Example 3.
Figure 6:
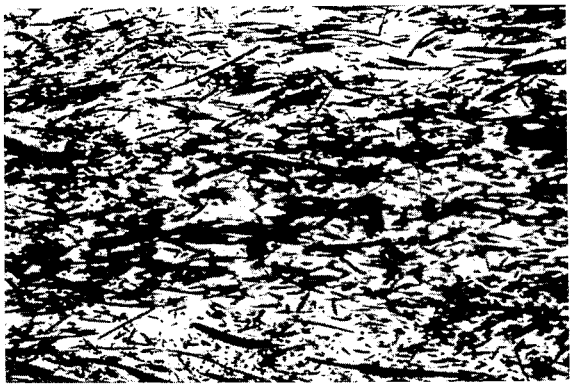
FIG. 6 is an enlarged photograph showing the shape of the fibers on the X-Y cross-section plane, in FIG. 5, of FRM produced from the fiber aggregate produced in Example 3.
Figure 7:
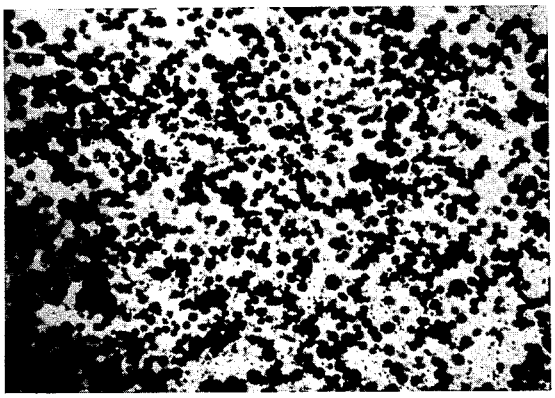
FIG. 7 is an enlarged photograph showing the shape of the fibers on the Y-Z cross-section plane, in FIG. 5, of FRM produced from the fiber aggregate produced in Example 3.
Figure 8:
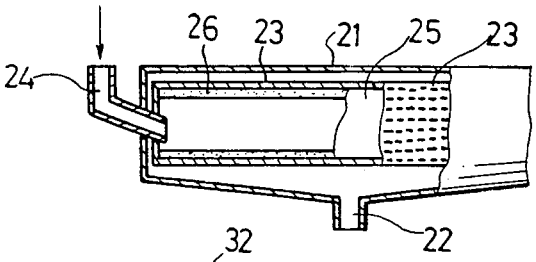
FIG. 8 (PRIOR ART)
FIG. 8 is a partly cutaway sectional view of the conventional centrifugal forming apparatus.
Figure 9:
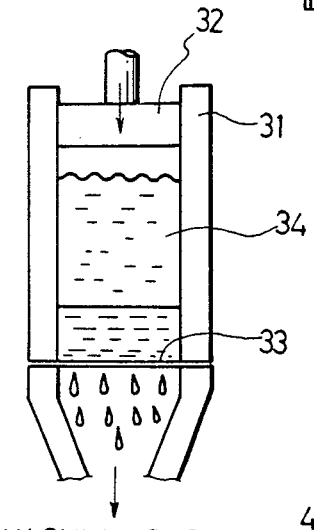
FIG. 9 (PRIOR ART)
FIG. 9 is an illustrative sectional view of the conventional suction forming apparatus.
Figure 10:
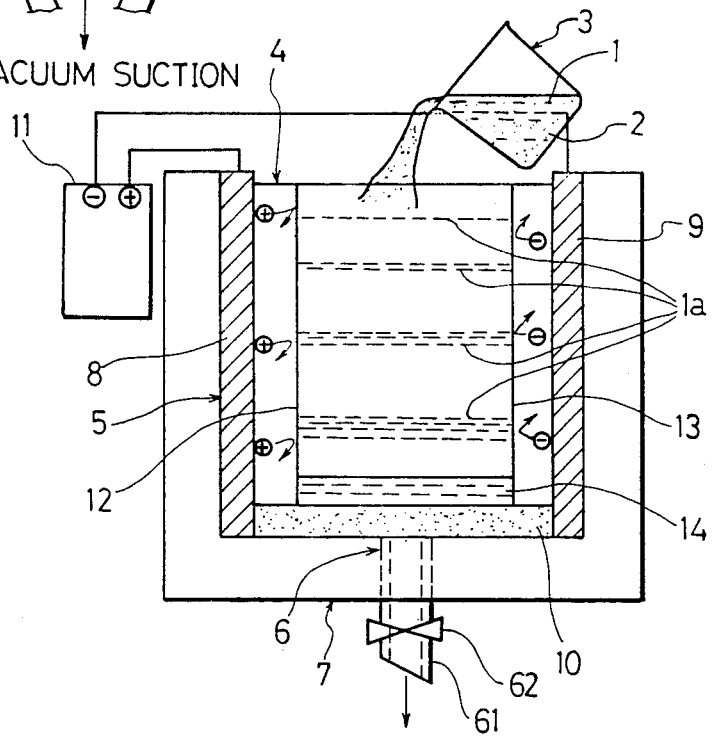
FIG. 10 is a sectional view illustrating the process for producing fiber aggregate in Example 4 and 5, the process including the step of filtering the dielectric fluid through a porous filter.

The one-dimensional orientation of the fiber aggregate was evaluated by producing FRM of aluminum alloy (A1-4Cu-2Mg). The resulting FRM has the axes of three dimensions (XYZ) as schematically shown in FIG. 5. A photograph (with a magnification of $\times 100$) of the X-Y cross section is shown in FIG. 6 and a photograph (with a magnification of $\times 400$) of the Y-Z cross section is shown in FIG. 7. In these photographs, black parts represent the fibers and white parts represent the matrix metal. FIG. 6 shows the longitudinal cross-section of the fibers oriented in the direction of X-axis; and FIG. 7 shows the cross-section of the fibers of the Y-Z cross section. It is apparently noted that most fibers are one-dimensionally oriented in the direction of X-axis.

The resulting FRM was found to have a flexural strength of 87.2 kgf/mm$^2$. In the case of FRM made from the same matrix metal as mentioned above and fiber aggregate of two-dimensional random orientation, the flexural strength was 75 kgf/mm$^2$. The flexural strength of the matrix metal alone was 58 kgf/mm$^2$. (The fiber-volume ratio in the former case was 30%, and that in the latter case was 25%.) It is noted that FRM in this example has high flexural strength.

(Example 4)

The turbulence of the dielectric fluid was investigated in this example. The apparatus made up of the orientation vessel 7, the paired positive electrode 8 and negative electrode 9, the convection preventing membranes each disposed near the positive electrode and negative electrode 9, and the high voltage source 11. The orientation vessel 7 is made up of the receptacle 4 to receive the dielectric fluid into which short fibers are dispersed; the outlet 6 to discharge the dielectric fluid; and the orientation space 5 in which the dielectric fluid moves downward across the receptacle 4 and the outlet 6. The positive electrode 8 and negative electrode 9 are vertically disposed a certain distance apart horizontally in the orientation space 5 of the orientation vessel 7. The high-voltage source 11 applies a high voltage across the positive electrode 8 and negative electrode 9. The distance between the electrodes is 70 mm. The convection preventing membrane is an ion-exchange resin membrane or paper, which is disposed 5 mm away from each electrode.

Carbon tetrachloride was placed in the space between the electrodes in the electrostatic orientation apparatus. A DC voltage of 5 kV, 10 kV, or 15 kV was applied, and the turbulence of the dielectric fluid was investigated.

In the case where the anion exchange resin membrane is disposed inside the positive electrode and the cation exchange resin membrane is disposed inside the negative electrode, the result was that very little convection occurred when 5 kV was applied, partial turbulence occurred at the positive electrode side alone when 10 kV was applied, and overall turbulence occurred when 15 kV was applied. In the case where paper was disposed inside the electrodes, almost the same effect as mentioned was slightly larger when 10 kV was applied. Incidentally, in the case where the convection preventing membrane was not used, a comparatively large turbulence occurred at the negative electrode side as shown in FIG. 11 when 5 kV was applied. This turbulence eventually disturbed the entire dielectric fluid.

It was demonstrated that the convection preventing membrane effectively prevents the convection or turbulence of the dielectric fluid when a high voltage is applied.

(Example 5)

Fiber aggregate was produced by using an ion-exchange resin membrane as the convection preventing membrane in consideration of the result in Example 4.

Alumina short fibers (having an average diameter of 3 μm and a length of 10 to 500 μm) without surface treatment were dispersed by stirring together with a small amount of nonionic surface active agent in carbon tetrachloride as the dielectric fluid, as in Example 1. The electrostatic orientation apparatus as used in Example 4 was made ready for fiber dispersion. Dielectric liquid was placed in the space between the electrodes in the apparatus. A DC voltage of 10 kV was applied across the electrodes. The dielectric liquid into which the fibers were dispersed was slowly poured into the receptacle 4 of the apparatus from the beaker.

The fiber 1 underwent induction polarization in the dielectric fluid and electrostatic orientation, with one end of the fiber pointing to the positive electrode 8 and the other end pointing to the negative electrode 9. (This state is referred to as one-dimensional orientation.) The electrostatically oriented fibers 1*a* become strung while they were settling, and the strung fibers settled in the state of one-dimensional orientation in the direction across the positive and negative electrodes.

With the electrostatically oriented fibers kept as they were, the drain cock 63 on the drain pipe 62 was opened to discharge the dielectric fluid through the filter 61 in the one-dimensionally oriented state.

The dielectric fluid remaining in the apparatus was removed through the drain pipe 62. Thus there was obtained the fiber aggregate 10 in the form of mat (measuring 80 mm long and 10 to 20 mm thick).

The one-dimensional orientation of the fiber aggregate was evaluated by producing FRM of aluminum alloy (AL-4Cu-2Mg). Upon examination of the Y-Z cross section (not shown), it was found that the fibers have a round cross-section. This apparently indicates that the fibers are one-dimensionally oriented in the direction of X axis.

The resulting FRM was found to have a flexural strength of 87.2 kgf/mm$^2$. In the case of FRM made from the same matrix metal as mentioned above and fiber aggregate of two-dimensional random orientation, the flexural strength was 75 kgf/mm$^2$. The flexural strength of the matrix metal alone was 58 kgf/mm$^2$. (The fiber volume ratio in the former case was 25%, and that in the latter case was 30%.) It is noted that FRM in this example has a high flexural strength.

The fiber aggregates in Examples 4 and 5 were found to have a higher fiber volume ratio than the conventional one because of the one-dimensional orientation. The fiber aggregate was also found to have a low degree of spring back. Because of these characteristics, it provides FRM of high precision.

According to the process in this example, the dielectric fluid is removed through a corrosion-resistant porous filter attached to the bottom of the orientation space in which the oriented fibers are aggregated. Therefore, no turbulence occurs when the dielectric fluid is discharged and hence the orientation of the fibers is not disturbed and the fiber aggregate of good orientation is obtained.

In addition, according to the process in this example, the dielectric fluid is discharged continuously through the drain pipe so that the aggregation of fiber can be carried out in a short time.

The fiber aggregate obtained in this example is in the form of mat about 10 to 20 mm thick. The mat can be cut to desired shape or placed on top of another to form a fiber aggregate for FRM of varied shape.

(Example 6)

(1) The turbulence of the dielectric fluid was investigated in this example. The apparatus for removing ionic substances as shown in FIG. 12 was made ready for experiment. It is enclosed in the holder 43 provided with inlet 47 and outlet 48. The inlet 47 is provided with a filter 46. The holder 43 has the paired positive electrode 41 and the negative electrode 42 arranged vertically a certain distance apart horizontally. The anion exchange membrane 44 is disposed inside the positive electrode 41 and the cation exchange membrane 45 is disposed inside the negative electrode 42.

The dielectric fluid (carbon tetrachloride) discharged from the electrostatic orientation apparatus is introduced into the ionic substance removing apparatus through the inlet 47, so that solids in the dielectric fluid are removed by the filter 46. A high voltage is applied across the electrodes 41 and 42. Ions in the dielectric fluid are attracted toward the electrodes; but their movement is restricted in one-direction by the ion exchange membranes 44 and 45. Cations are passed through the cation exchange membrane to be removed. Anions are passed through the anion exchange membrane to be removed. After removal of ionic substances, the dielectric fluid is discharged from the outlet 48.

The electrostatic orientation apparatus used in Example 1 (as shown in FIG. 1) was made ready for experiment. The distance between the electrodes is 70 mm. The carbon tetrachloride, in which ionic substances were removed as mentioned above, was introduced into the space between the electrodes in the electrostatic orientation apparatus. The turbulence of the dielectric fluid which occurs upon application of a high voltage of about 5, 10, or 15 kV was investigated.

Very little turbulence occurred when 5 kV was applied, partial turbulence occurred when 10 kV was applied, and overall turbulence occurred when 15 kV was applied.

In the case where the dielectric fluid does not undergo the step of removing ionic substances, a comparatively large turbulence occurred at the negative electrode side as shown in FIG. 11 when 5 kV was applied. This turbulence eventually disturbed the entire dielectric fluid.

(2) Fiber aggregate of one-dimensional orientation was produced as follows: Alumina short fibers (having an average diameter of 3 μm and a length of 10 to 500 μm) without surface treatment were dispersed by stirring together with a small amount of nonionic surface active agent into the dielectric fluid, in which ionic substances were removed as mentioned above.

The dielectric fluid into which the fibers were dispersed was slowly poured into the receptacle 4 of the electrostatic orientation apparatus from the beaker.

The fibers 1 underwent induction polarization in the dielectric fluid and electrostatic orientation, with one end of the fiber pointing to the positive electrode 8 and the other end pointing to the negative electrode 9. The electrostatically oriented fibers la became strung while they were settling, and the strung fibers settled in the state of one-dimensional orientation in the direction across the positive and negative electrodes.

With the electrostatically oriented fibers kept as they were, the drain cock 63 on the drain pipe 62 was opened to discharge the dielectric fluid through the filter 61. In this way, the fibers were aggregated on the filter 61 in the one-dimensional oriented state.

The dielectric fluid remaining in the apparatus was removed through the drain pipe 62. Thus there was obtained the fiber aggregate 10 in the form of mat.

Since the dielectric fluid, in which ionic substances were removed, is used in this example, the concentration of ionic substances is lower in the orientation vessel than in the case where the dielectric fluid, in which ionic substances were not removed. Therefore, the convection of the dielectric fluid caused by the presence of ionic substances is prevented in this example, and the one-dimensional orientation of fiber is accomplished more stably. Thus the fiber aggregate 10 is one which has a good state of one-dimensional orientation. The process in this example makes it possible to produce the fiber aggregate from fibers of smaller size owing to its capability of orientation.

The fiber aggregate in this example was found to have a higher fiber-volume ratio than the conventional one because of the one-dimensional orientation. The fiber aggregate was also found to have a low degree of spring back. Because of these characteristics, it provides FRM of high precision.

According to the process in this example, the dielectric fluid is removed through a corrosion-resistant porous filter attached to the bottom of the orientation space in which the oriented fibers are aggregated. Therefore, convection of the dielectric fluid discharged is prevented and hence the orientation of the fibers is not disturbed and the fiber aggregate of good orientation is obtained.

In addition, according to the process in this example, the dielectric fluid is discharged continuously through the drain pipe so that the aggregation of fiber can be carried out in a short time.

What is claimed is:

1. A process for producing fiber aggregate which comprises:

a dispersion step of mixing fibers in the form of short fibers, whiskers, or a mixture thereof, a dielectric liquid having a resistivity of $10^{14}$ or more and a surface active agent, for dispersing said fibers in the resulting liquid having a resistivity from $4\times10^{11}$ to $6\times10^{12}$ ohm·cm;

an orientation step of placing said dielectric liquid containing said fibers dispersed therein between a positive electrode and a negative electrode across which a high voltage is applied, wherein individual fibers in said dielectric liquid are electrostatically oriented along electric lines of force; and an aggregating step of aggregating the electrostatically oriented fibers while maintaining the direction of orientation of the fibers wherein fiber aggregate in which said fibers are substantially one-dimensionally oriented is produced.

2. A process for producing fiber aggregate which comprises:

a dispersion step of mixing fibers in the form of short fibers, whiskers, or a mixture thereof, a dielectric liquid having a resistivity of $10^{14}$ or more and a surface active agent, for dispersing said fibers in the resulting liquid having a resistivity of from $4\times10^{10}$ to $1\times10^{13}$ ohm·cm;

an orientation step of placing said dielectric liquid containing said fibers dispersed therein between a positive electrode and a negative electrode across which a high voltage is applied, wherein a convection-preventing membrane for stabilizing the electrostatic orientation of the fibers is disposed adjacent at least one of the electrodes on the side of said at least one electrode toward the other of the electrodes, and wherein individual fibers in said dielectric liquid are electrostatically oriented along electric lines of force; and an aggregating step of aggregating the electrostatically oriented fibers while maintaining the direction of orientation of the fibers wherein fiber aggregate in which said fibers are substantially one-dimensionally oriented is produced.

3. A process for producing fiber aggregate according to claim 2, wherein in the dispersion step, said dielectric liquid has a resistance of from $4\times10^{11}$ to $6\times10^{12}$ ohm·cm.

4. A process for producing fiber aggregate according to claim 1 wherein the surfactant/fiber ratio is between about 0.02 to 0.0002 wt %.

* * * * *